US007407119B2

(12) United States Patent
Czimmek

(10) Patent No.: US 7,407,119 B2
(45) Date of Patent: Aug. 5, 2008

(54) MAGNETIC CIRCUIT USING NEGATIVE MAGNETIC SUSCEPTIBILITY

(75) Inventor: Perry R. Czimmek, Williamsburg, VA (US)

(73) Assignee: Continental Automotive Systems US, Inc., Auburn Hills ( * ) Notice: Subject to any disclaimer, the term of this patent is extended or adjusted under 35 U.S.C. 154(b) by 121 days.

(21) Appl. No.: 10/848,000

(22) Filed: May 19, 2004

(65) Prior Publication Data

US 2005/0258283 A1 Nov. 24, 2005

(51) Int. Cl.
*B05B 1/30* (2006.01)

(52) U.S. Cl. ..... 239/585.1; 239/585.4; 239/585.5; 239/900; 239/DIG. 19; 251/129.21

(58) Field of Classification Search ... 239/585.1–585.5, 239/584.4, 584.5, 900, DIG. 19; 251/129.15, 251/129.21

See application file for complete search history.

(56) References Cited

U.S. PATENT DOCUMENTS 4,127,835 A * 11/1978 Knutson ..... 335/266
4,313,571 A * 2/1982 Bellicardi et al. ..... 239/585.5
4,524,948 A * 6/1985 Hall ..... 251/129.21
5,088,467 A 2/1992 Mesenich
5,207,387 A * 5/1993 Bergstrom ..... 239/585.4
5,450,876 A 9/1995 Reinicke
5,544,816 A 8/1996 Nally et al.
5,560,386 A 10/1996 Reiter et al.
5,782,267 A * 7/1998 Yoo ..... 137/596.17
6,032,879 A * 3/2000 Hamada et al. ..... 239/585.1
6,201,461 B1 * 3/2001 Eichendorf et al. ..... 335/256
6,279,843 B1 8/2001 Coldren et al.
6,390,443 B1 5/2002 Katayama et al.
6,431,474 B2 * 8/2002 Fochtman et al. ..... 239/585.4
6,676,044 B2 1/2004 Dallmeyer et al.
6,688,853 B1 * 2/2004 Burkett et al. ..... 417/222.2
2002/0134958 A1 9/2002 Migliori

OTHER PUBLICATIONS

"Magnet Levitation At Your Fingertips"; Nature; vol. 400; Jul. 22, 1999; (pp. 323-324).
Magnetic Susceptibilities of Paramagnetic and Diamagnetic Materials at 20° C; www.cartage.org.lb; Apr. 9, 2004; (p. 1 of 1).

* cited by examiner

*Primary Examiner*—Kevin P. Shaver
*Assistant Examiner*—Jason J Boeckmann

(57) ABSTRACT

A fuel injector for an internal combustion engine including a body, a stator member, an armature, an electromagnetic coil, and a diamagnetic member. The body includes a passage extending along a longitudinal axis between inlet and outlet ends. The armature member is movable with respect to the stator member between a first configuration and a second configuration, and includes a closure member proximate the outlet end and contiguous to a seat in the first configuration, and spaced from the seat in the second configuration. The electromagnetic coil surrounds the passage, is disposed in a housing, and is energizable to provide magnetic flux that moves the armature between the first and second configuration to permit fuel flow through the passage. The diamagnetic member is proximate the electromagnetic coil so that when the electromagnetic coil is energized the magnetic flux flows around the diamagnetic member.

13 Claims, 4 Drawing Sheets

MAGNETIC CIRCUIT USING NEGATIVE MAGNETIC SUSCEPTIBILITY

FIELD OF THE INVENTION

This invention relates generally to an electromagnetic actuator that may be used, for example, in an electromagnetic fuel injector for an internal combustion engine, and more particularly to an electromagnetic actuator having reduced magnetic flux leakage.

BACKGROUND OF THE INVENTION

A known electromagnetic actuator for an electromagnetic fuel injector includes a stator member, an armature member and an electromagnetic coil. The electromagnetic coil is energizable to flow magnetic flux through a designed magnetic circuit. The magnetic circuit includes the stator member and the armature member, and creates a magnetic force to move the armature member relative to the stator member. Some magnetic flux may short-circuit off of the designed magnetic circuit, for example through the coil, rather than through the armature member, resulting in magnetic flux leakage. It is believed that known electromagnetic actuators are designed to reduce magnetic flux leakage by using air gaps or non-magnetic materials to direct the magnetic flux through the designed magnetic circuit.

In the design of known actuators, the air gaps or non-magnetic materials have a minimum magnetic permeability, $\mu$, assumed to be that of free space, $\mu_o$, or $4\pi\times10^{-7}$ Webers/amp-meter in SI units, which in Centimeter-Gram-Second units is the unity relative permeability value, $\mu_r=1$. The maximum relative permeability in known designs is usually defined by the ferromagnetic components in the magnetic circuit, the value often being in the thousands. However, in known designs, a significant amount of useful magnetic flux is lost as magnetic flux leakage. It is believed that there is a need to reduce or eliminate this magnetic flux leakage.

SUMMARY OF THE INVENTION

In an embodiment, the invention provides a fuel injector for an internal combustion engine, including a body, a stator member, an armature, an electromagnetic coil, and a diamagnetic member. The body includes a passage extending along a longitudinal axis between inlet and outlet ends. The armature member is movable with respect to the stator member between a first configuration and a second configuration, and includes a closure member proximate the outlet end and contiguous to a seat in the first configuration, and spaced from the seat in the second configuration. The electromagnetic coil surrounds the passage, is disposed in a housing, and is energizable to provide magnetic flux that moves the armature between the first and second configuration to permit fuel flow through the passage. The diamagnetic member is proximate the electromagnetic coil so that when the electromagnetic coil is energized, the magnetic flux flows around the diamagnetic member.

The diamagnetic member may be formed of bismuth, pyrolytic graphites, perovskite copper-oxides, alkali-metal tungstenates, vandanates, molybdates, titanate niobates, $NaWO_3$, $YBa_2Cu_3O_7$, $TiBa_2Ca_2Cu_3O_3$, $Al_xGa_{1-x}As$, and Cr, Fe selenides. A magnetic susceptibility of the diamagnetic member may be less than or equal to −0.25, less than or equal to −0.5, or less than or equal to −0.75.

The electromagnetic coil may include a hollow core. The diamagnetic member may include a wall defining a hollow cylinder, the wall having an inner surface and an outer surface, and first and second ends. The diamagnetic member may be disposed at least partially in the hollow core. The coil housing may surround the coil, the inner surface of the wall may confront a portion of the stator, and the outer surface of the wall may be contiguous to a portion of the coil. The diamagnetic member may include a first flange formed at the first end of the wall, and a second flange formed at the second end of the wall. The first and second flanges may extend radially outward from the outer surface of the wall to define a bobbin. The electromagnetic coil may be disposed proximate the outer surface of the cylindrical wall, and the stator may be at least partially disposed proximate the inner surface of the cylindrical wall. The diamagnetic member may include a polymer having a diamagnetic material suspended therein. A lower surface of the stator member and an upper surface of the armature member may define a working gap, and the diamagnetic member may direct the magnetic flux through the working gap.

In another embodiment, the invention provides an actuator including a stator member, an armature member, an electromagnetic coil, and a diamagnetic member. The diamagnetic member is proximate the coil, and has a magnetic susceptibility of less than −0.15 so that when the electromagnetic coil is energized, the diamagnetic member forms a barrier to magnetic flux.

The diamagnetic member may include a wall defining a hollow cylinder, the wall having an inner surface and an outer surface, and first and second ends. A thickness of the wall may be approximately 20 microns or greater.

The diamagnetic member may include a first flange formed at the first end of the wall, and a second flange formed at the second end of the wall. The first and second flanges may extend radially outward from the outer surface of the wall to define a bobbin. The diamagnetic member may include a polymer having a diamagnetic material suspended therein.

In yet another embodiment, the invention provides a method of actuating an electromagnetic actuator having a stator member, an armature member, and an electromagnetic coil. The method includes forming a barrier to magnetic flux, and directing the magnetic flux between the stator member and the armature member. The forming a barrier to magnetic flux may include providing a diamagnetic member having a magnetic susceptibility of less than or equal to −0.15. The method may include generating an axial magnetic force between the stator member and the armature member; and increasing the axial magnetic force by about 14% with another diamagnetic member having a magnetic susceptibility of less than or equal to −0.98.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
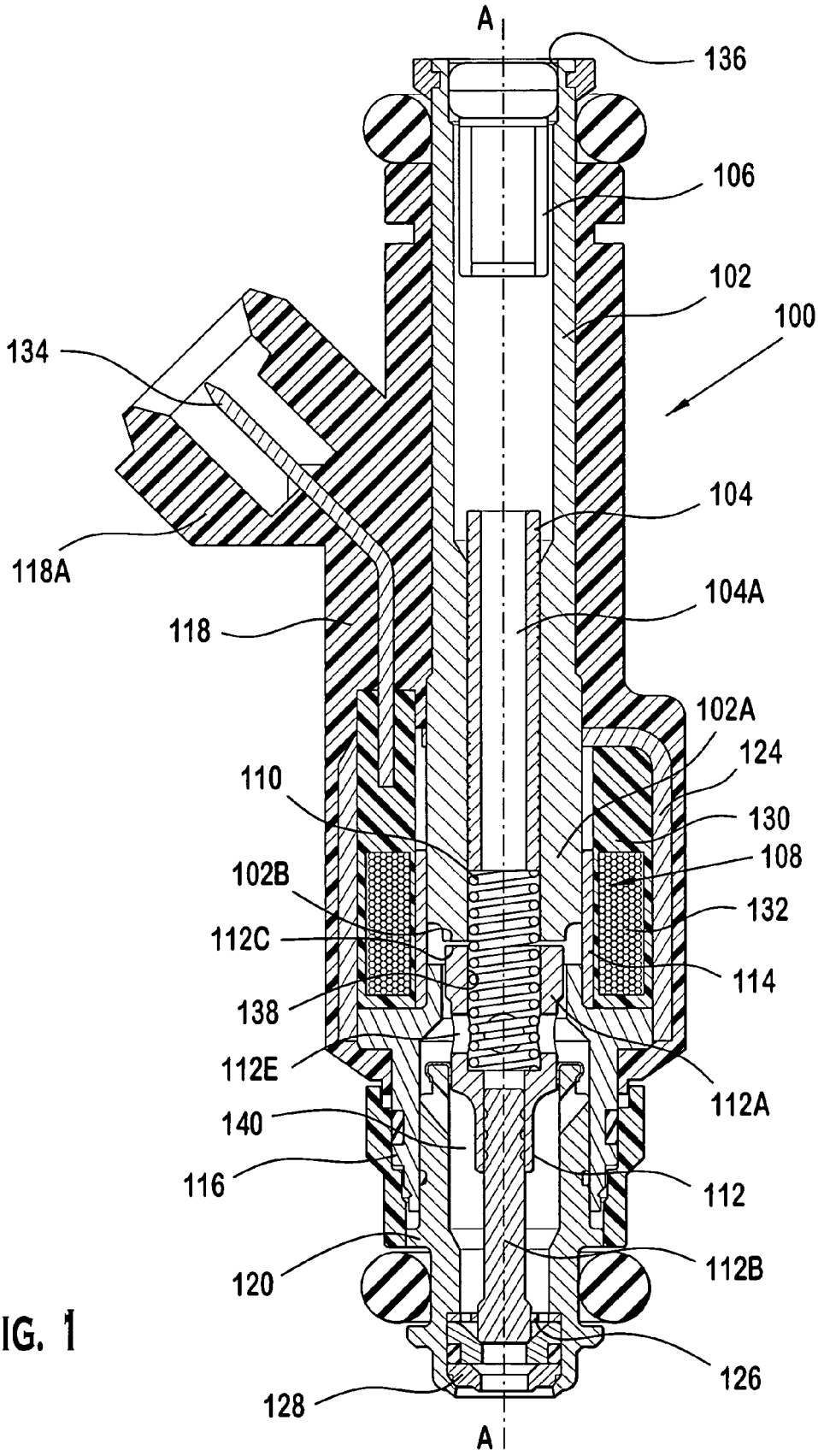
FIG. 1 is a cross-sectional view of an electromagnetic fuel injector including a magnetic circuit, according to an embodiment of the invention.

FIGS. 1, 2, 3B and 4B illustrate preferred embodiments. One preferred embodiment, an electromagnetic fuel injector 100, is provided. The fuel injector 100 includes an inlet tube 102, an adjustment tube 104, a filter assembly 106, an electromagnetic coil assembly 108, a biasing spring 110, an armature assembly 112 including an armature member 112A and closure member 112B, a diamagnetic member 114, an overmold 118, a first ferromagnetic body 116, a second body 120, a ferromagnetic coil assembly housing 124, a guide member 126, and a seat 128.

Figure 2:
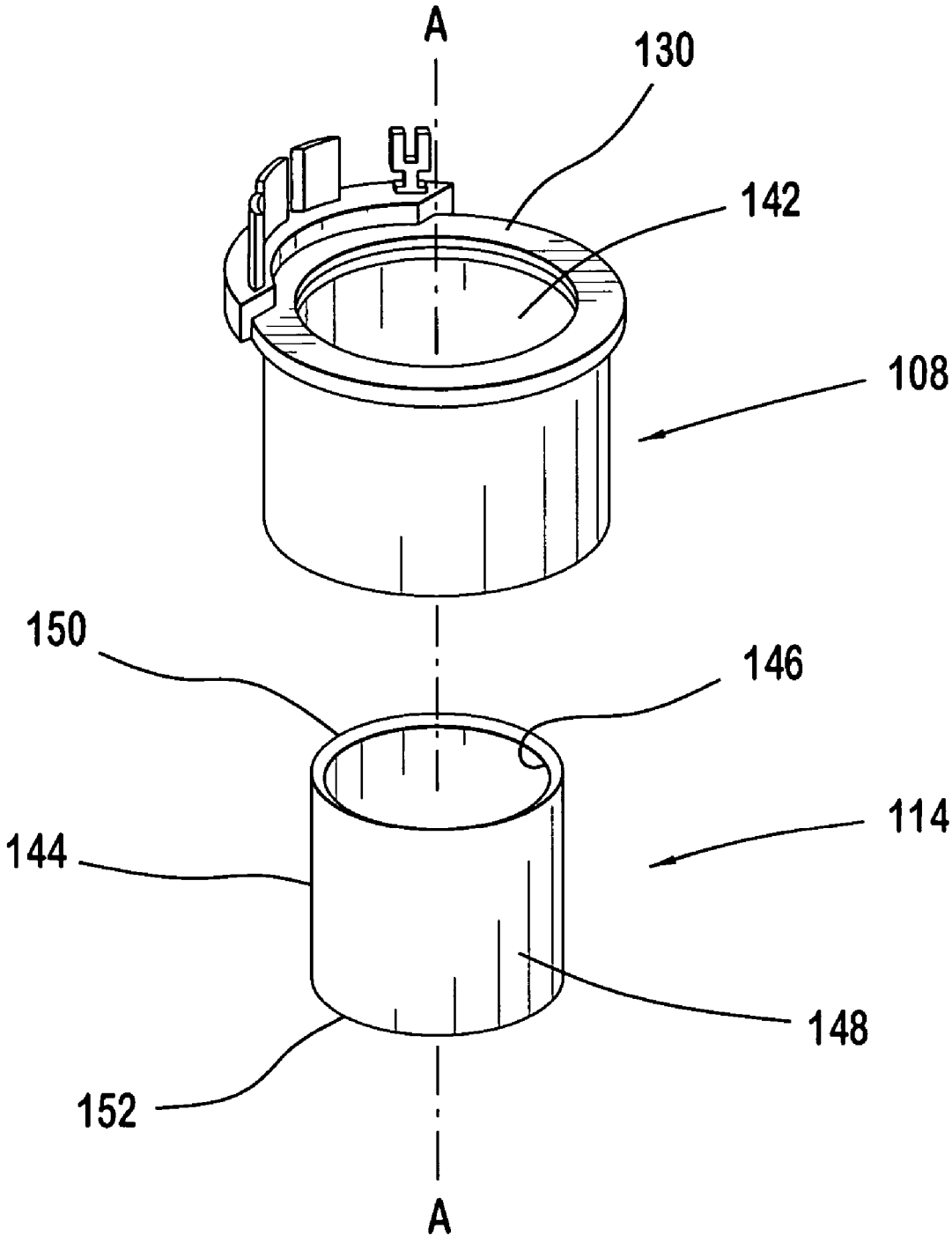
FIG. 2 is an exploded view of components of a magnetic circuit, according to an embodiment of the invention.

Referring to FIG. 2, coil assembly 108 may include a plastic bobbin 130 on which an electromagnetic coil 132 is wound. Respective terminations of coil 132 connect to respective terminals 134 that are shaped and, in cooperation with a surround 118A, formed as an integral part of overmold 118, to form an electrical connector for connecting the fuel injector 100 to an electronic control circuit (not shown) that operates the fuel injector 100. The diamagnetic member 114 can be inserted into the coil or formed unitarily as part of the bobbin 130.

Inlet tube 102 may be formed of a ferromagnetic material so that a lower end 102A of the inlet tube is a stator member, as described below. Inlet tube 102 includes a fuel inlet opening 136 at the exposed upper end. Filter assembly 106 can be fitted proximate the open upper end of adjustment tube 104 to filter any particulate material from the fuel entering through inlet opening 136, before the fuel enters adjustment tube 104. After passing through a passageway 104A in adjustment tube 104, fuel enters a volume 138 that is cooperatively defined by confronting ends of inlet tube 102 and armature assembly 112, and that contains spring 110. Armature assembly 112 includes a passageway 112E that communicates volume 138 with the seat 128.

Fuel injector 100 may be calibrated by positioning adjustment tube 104 axially within inlet tube 102 to preload spring 110 to a desired bias force. The bias force urges the closure member 112B to be seated on seat 128 so as to close the central hole through the seat.

In operation, the electromagnetic coil 132 is energized, thereby generating magnetic flux in a magnetic circuit that includes ferromagnetic components of the fuel injector 100. The magnetic circuit includes the stator member 102A, the coil housing 124, the body 116, and the armature member 112A. The magnetic flux moves from the body 116, across a side air gap between the armature 112A and the body 116, through the armature 112A, and across a working air gap between end portions 102B and 112C, and through the stator member 102, thereby creating a magnetic force across the working gap to move the armature member 112A toward the stator member 102A along the axis A-A, closing the working gap. This movement of the armature assembly 112 separates the closure member 112B from the seat 128, and allows fuel to flow from a fuel rail (not shown), through the inlet tube 102, the passageway 104A, the aperture 112E, the body 120, and through an opening in the seat 128 into the internal combustion engine (not shown). When the electromagnetic coil 132 is de-energized, the armature assembly 112 is moved by the bias of the spring 110 to seal the closure member 112B on the seat 128, and thereby prevent fuel flow through the injector 100.

As the magnetic flux flows along the magnetic circuit, some magnetic flux may not flow along the desired magnetic flow path, i.e. "short circuiting" the designed magnetic circuit, for example through the electromagnetic coil 132, rather than through the armature member 112A, resulting in magnetic flux leakage. As described, a preferred technique to reduce the flux leakage is by focusing the magnetic flux along the magnetic circuit with a diamagnetic member. Magnetic susceptibility is a measure of a material's acceptance of magnetic flux. If the magnetic susceptibility of a material is positive in value, then the material is paramagnetic, ferrimagnetic or ferromagnetic. If the magnetic susceptibility of a material is negative in value, then the material is diamagnetic. And if the magnetic susceptibility of a material is zero, then the material is anti-ferromagnetic. Magnetic susceptibility, $\kappa$, in terms of relative permeability, is: $\mu-1=\kappa$. Therefore, the magnetic susceptibility of free space is zero, $\kappa_o=0$. There are, however, materials with negative relative magnetic susceptibilities. These materials may be referred to as diamagnetic if their susceptibilities are slightly negative, giant-diamagnetic if their susceptibilities are strongly negative, or Meissner Effect materials (named for Walter Meissner, 1933) if they exhibit a total exclusion of magnetic fields. Meissner effect materials are at negative unity magnetic susceptibility, which would give them a relative permeability of zero, $\mu_r=0$. By using negative magnetic susceptibility materials to focus magnetic flux along a designed magnetic circuit, magnetic flux leakage may be reduced or practically eliminated. Diamagnetic member 114 focuses the magnetic flux through the armature member 112A, and reduces or practically eliminates magnetic flux leakage.

Diamagnetic member 114 may be formed of any suitable material having a magnetic susceptibility in a range of $-1.0 \leqq \kappa \leqq 0$. For example, diamagnetic member 114 may be formed of bismuth, pyrolytic graphites, perovskite copper-oxides, alkali-metal tungstenates, vandanates, molybdates, and titanate niobates. Examples include $NaWO_3$, $YBa_2Cu_3O_7$, $TiBa_2Ca_2Cu_3O_3$, $Al_xGa_{1-x}As$, and Cr, Fe selenides. The diamagnetic member 114 may be formed of a polymer having a diamagnetic material suspended in the polymer. For example, the polymer may be olefin, acrylate, urethane or silicone. Preferably, the diamagnetic member 114 is characterized by its diamagnetic property in static magnetic fields, and by a negative magnetic susceptibility, regardless of electrical conductivity. Referring to FIG. 2, the diamagnetic member may include a wall 144 defining a hollow cylinder. The wall 144 may have an inner surface 146, an outer surface 148, and first and second ends 150, 152. The diamagnetic member may be disposed in a hollow core 142 of the coil assembly 108.

Figure 3B:
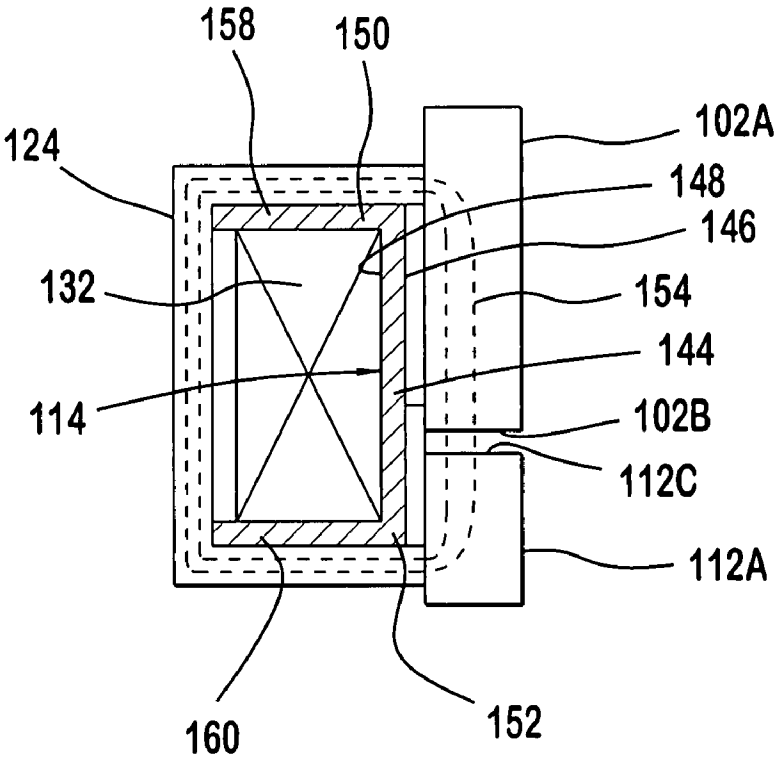
FIG. 3B is a schematic illustration of a magnetic circuit, according to an embodiment of the invention.
Figure 3A:
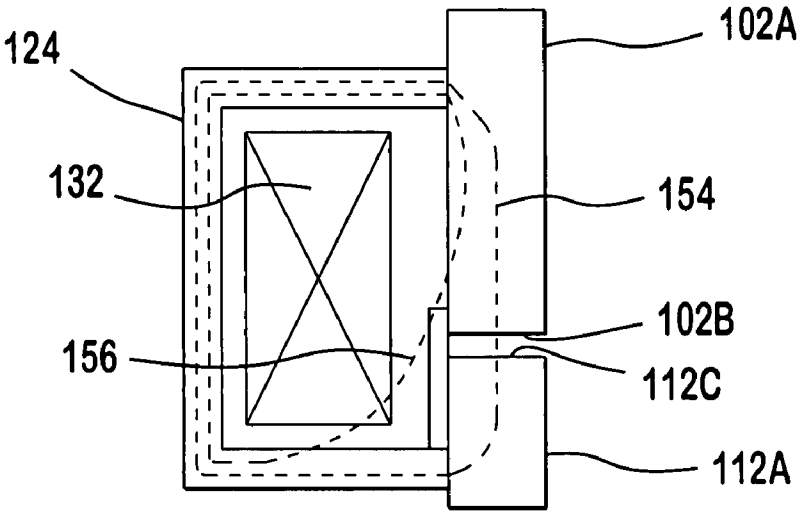
FIG. 3A is a schematic illustration of a conventional magnetic circuit.

For comparative illustrations of advantages of the preferred embodiments, FIGS. 3A and 3B show magnetic flux in a magnetic circuit. FIG. 3A schematically illustrates magnetic flux in a magnetic circuit that does not include a diamagnetic member 114. The magnetic circuit includes the stator member 102A, the coil housing 124, and the armature member 112A. The magnetic flux 154 moves from housing 124, across a parasitic air gap between the housing and the armature, through the armature 112A, and across a working air gap between end portions 102B and 112C, and through the stator member 102A, thereby creating a magnetic force across the working gap to move the armature member 112A toward the stator member 102A and closing the working gap. As the magnetic flux flows along the magnetic circuit, some magnetic flux 156 short circuits off of the designed magnetic circuit, for example through the electromagnetic coil 132, rather than through the armature member 112A, resulting in magnetic flux leakage.

FIG. 3B schematically illustrates magnetic flux in a magnetic circuit that includes a diamagnetic member 114. In the embodiment of FIG. 3B, the diamagnetic member 114 includes a first flange 158 formed at the first end 150 of the wall 144, and a second flange 160 formed at the second end 152 of the wall 144. The first and second flanges 158, 160 extend radially outward from the outer surface 148 of the wall to define a bobbin. The electromagnetic coil 132 may be disposed proximate the outer surface 148 of the cylindrical wall 144, and the stator member 112A may be disposed proximate the inner surface 146 of the cylindrical wall 144. The magnetic circuit includes the stator member 102A, the coil housing 124, and the armature member 112A. The magnetic flux 154 moves from housing 124, across a parasitic air gap between the housing and the armature, through the armature 112A, and across a working air gap between end portions 102B and 112C, and through the stator member 102A, thereby creating a magnetic force across the working gap to move the armature member 112A toward the stator member 102A and closing the working gap. As the magnetic flux flows along the magnetic circuit, the magnetic flux flows around the diamagnetic member 114, rather than through the diamagnetic member, due to its negative magnetic susceptibility, so that magnetic flux leakage, through the coil 132 for example, is reduced or practically eliminated. The diamagnetic member 114 forms a barrier to the magnetic flux so that substantially no magnetic flux flows across the the diamagnetic member. Because magnetic flux leakage is reduced or eliminated, the magnetic flux is focused through the stator member 112A and the working gap, thus increasing flux density to provide a larger magnetic force to move the armature member 112A toward the stator member 102A.

Figure 4B:
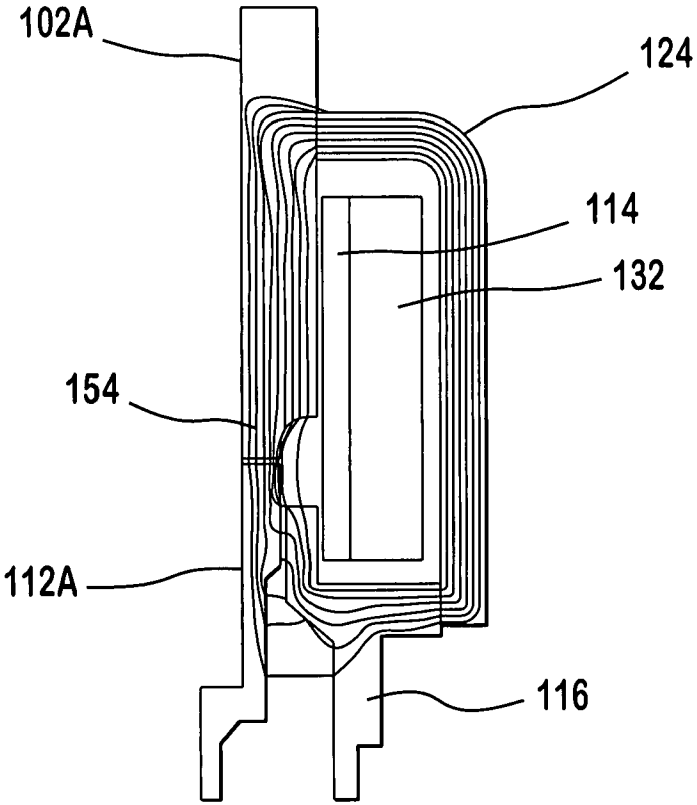
FIG. 4B is another schematic illustration of a magnetic circuit, according to an embodiment of the invention.
Figure 4A:
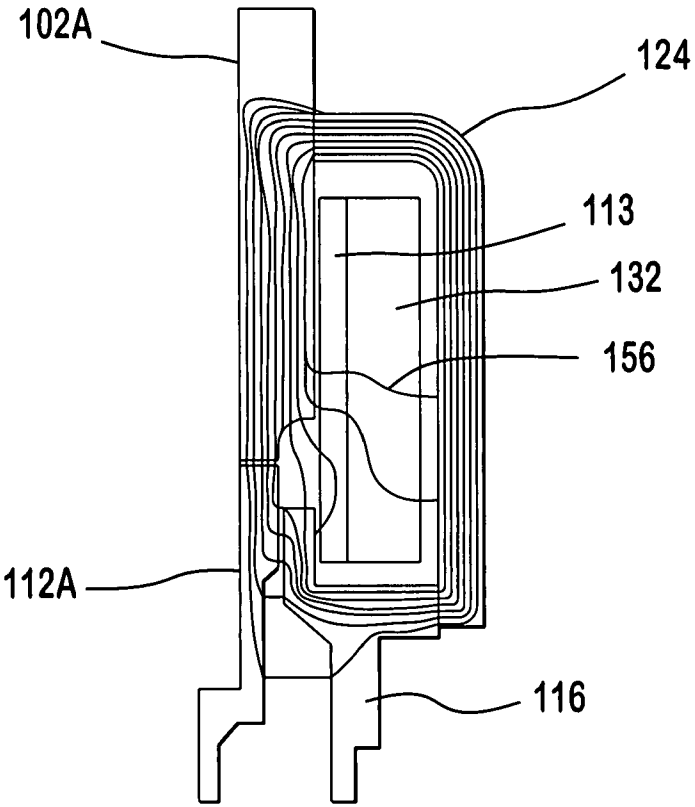
FIG. 4A is another schematic illustration of a conventional magnetic circuit.

FIGS. 4A and 4B illustrate the results of static magnetic modeling of the electromagnetic fuel injector 100 shown in FIG. 1. The working gap was set at 255 microns. Magnetomotive force was selected at 1000 Ampere-turns, close to the operating level of the injector 100 in normal use. FIG. 4A is a plot of magnetic flux in a fuel injector including cross-sectional area 113 having a permeability $\mu_r=1$, or $\kappa=0$, as with air, nylon, or non-magnetic stainless steel. Essentially, area 113 is non-diamagnetic. Magnetic flux leakage 156 flows through the coil 132. A static force of 18.26 N is generated in the working gap when the essentially non-diamagnetic area 113 is used.

FIG. 4B is a plot of magnetic flux in a fuel injector having member 114 formed of a material having a permeability of near-Meissner effect material such as hyperconductive polymer with $\mu_r<0.02$, or $\kappa=-0.98$. Magnetic flux leakage across the coil 156 is reduced or practically eliminated. A static force of 20.83 N is generated in the working gap when a diamagnetic member 114 is used in place of the area 113. The static force increased by approximately 14%, which is believed to be a significantly unexpected increase in the magnitude of force generated. As used herein, the term "member" can include a separate member or a unitarily formed portion of another structure.

While preferred embodiments of the invention are described with reference to the fuel injector assembly 100 illustrated in FIG. 1, it is to be understood that preferred embodiments of the invention may be included with other fuel injector assemblies. For example, embodiments of the invention may be included with modular the fuel injector assemblies shown and described in U.S. Pat. No. 6,676,044, the entirety of which is incorporated by reference.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A fuel injector for an internal combustion engine, comprising:

a body having a passage extending along a longitudinal axis between inlet and outlet ends;

a stator member;

an armature member being movable with respect to the stator member between a first. configuration and a second configuration, the armature member including a closure member proximate the outlet end and contiguous to a seat in the first configuration, and spaced from the seat in the second configuration;

an electromagnetic coil surrounding the passage, the coil disposed in a housing and being energizable to provide magnetic flux that moves the armature between the first and second configuration to permit fuel flow through the passage between the inlet and outlet ends; and a diamagnetic member proximate the electromagnetic coil so that when the electromagnetic coil is energized the diamagnetic member focuses the magnetic flux to reduce magnetic flux leakage between the stator and the electromagnetic coil;

wherein the electromagnetic coil includes a hollow core, the diamagnetic member includes a wall defining a hollow cylinder, the wall having an inner surface and an outer surface, the diamagnetic member being disposed at least partially in the hollow core; and wherein the coil housing surrounds the coil, the inner surface of the wall confronts a portion of the stator, and the outer surface of the wall confronts a portion of the coil.

2. The electromagnetic fuel injector of claim 1, wherein the diamagnetic member is selected from a group of materials consisting essentially of bismuth, pyrolytic graphites, perovskite copper-oxides, alkali-metal tungstenates, vandanates, molybdates, titanate niobates, $NaWO_3$, $YBa_2Cu_3O_7$, $TiBa_2Ca_2Cu_3O_3$, $AI_xGa_{1-x}As$, and Cr, Fe selenides, and combinations thereof.

3. The electromagnetic fuel injector of claim 1, wherein a magnetic susceptibility of the diamagnetic member is less than −0.25.

4. The electromagnetic fuel injector of claim 1, wherein a magnetic susceptibility of the diamagnetic member is less than −0.5.

5. The electromagnetic fuel injector of claim 1, wherein a magnetic susceptibility of the diamagnetic member is less than −0.75.

6. The electromagnetic fuel injector of claim 1, wherein the wall of the diamagnetic member has first and second ends, and the diamagnetic member includes a first flange formed at the first end of the wall, and a second flange formed at the second end of the wall, the first and second flanges extending radially outward from the outer surface of the wall to define a bobbin.

7. The electromagnetic fuel injector of claim 6, wherein the electromagnetic coil is disposed proximate the outer surface of the cylindrical wall, and the stator is at least partially disposed proximate the inner surface of the cylindrical wall.

8. The electromagnetic fuel injector of claim 1, wherein the diamagnetic member includes a polymer having a diamagnetic material suspended therein.

9. The electromagnetic fuel injector of claim 6, wherein the diamagnetic member includes a polymer having a diamagnetic material suspended therein.

10. The electromagnetic fuel injector of claim 1, wherein a lower surface of the stator member generally orthogonal to the longitudinal axis, and an upper surface of the armature member generally orthogonal to the longitudinal axis define a working gap, the diamagnetic member directing the magnetic flux through the working gap.

11. An actuator including a stator member, an armature member being moveable with respect to the stator member between a first configuration and a second configuration, an electromagnetic coil being energizable to provide magnetic flux that moves the armature between the first and second configuration, and a diamagnetic member proximate the coil, the diamagnetic member having a magnetic susceptibility of less than −0.15 so that when the electromagnetic coil is energized, the diamagnetic member forms a barrier to magnetic flux and assists in moving the armature member between the first and second configuration;

wherein the diamagnetic member includes a wall defining a hollow cylinder, the wall having an inner surface and an outer surface, and first and second ends; and wherein the diamagnetic member includes a first flange formed at the first end of the wall, and a second flange formed at the second end of the wall, the first and second flanges extending radially outward from the outer surface of the wall to define a bobbin.

12. The actuator of claim 11, wherein a thickness of the wall is approximately 20 microns or greater.

13. The actuator of claim 11, wherein the diamagnetic member includes a polymer having a diamagnetic material suspended therein.

* * * * *